United States Patent [19]

Gale

[11] 4,019,833

[45] Apr. 26, 1977

[54] MEANS FOR RETAINING BLADES TO A DISC OR LIKE STRUCTURE

[75] Inventor: Anthony George Gale, Wollaton, England

[73] Assignee: Rolls-Royce (1971) Limited, London, England

[22] Filed: Oct. 31, 1975

[21] Appl. No.: 627,785

[30] Foreign Application Priority Data

Nov. 6, 1974 United Kingdom ..... 47904/74

[52] U.S. Cl. ..... 416/220 R; 416/95; 416/218

[51] Int. Cl.[2] ..... F01D 5/32

[58] Field of Search ..... 416/95.97, 96 A, 218, 416/220, 218 A

[56] References Cited

UNITED STATES PATENTS

| | | | |
|---|---|---|---|
| 2,985,426 | 5/1961 | Hunter et al. | 416/95 X |
| 2,988,324 | 6/1961 | Sutters | 416/220 X |
| 2,988,325 | 6/1961 | Dawson | 416/96 X |
| 2,998,959 | 9/1961 | Haworth et al. | 416/220 X |
| 3,010,696 | 11/1961 | Everett | 416/97 |
| 3,137,478 | 6/1964 | Farrell | 416/220 |
| 3,572,966 | 3/1971 | Borden et al. | 416/220 X |
| 3,635,586 | 1/1972 | Kent et al. | 416/97 |
| 3,644,058 | 2/1972 | Barnabei et al. | 416/95 |

FOREIGN PATENTS OR APPLICATIONS

| | | | |
|---|---|---|---|
| 960,069 | 4/1950 | France | 416/218 |

*Primary Examiner*—Everette A. Powell, Jr.
*Attorney, Agent, or Firm*—Cushman, Darby & Cushman

[57] ABSTRACT

In order to prevent axial movement of blades with respect to their rotor, a locking ring is provided which abuts the blades and is mounted from the disc by a bayonet connection. The blades engage with the ring to prevent its rotation with respect to the disc and consequent disconnection.

7 Claims, 3 Drawing Figures

MEANS FOR RETAINING BLADES TO A DISC OR LIKE STRUCTURE

Figure 1:
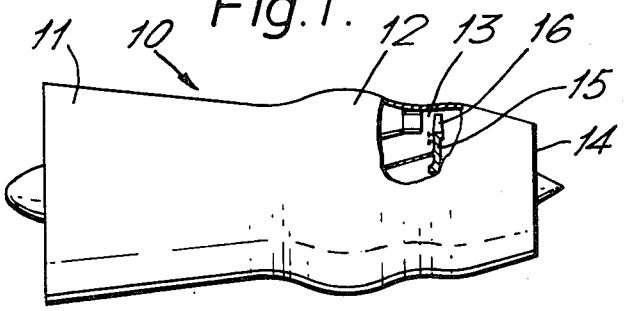

This invention relates to means for retaining blades to a disc or like structure, and is particularly but not exclusively concerned with means for retaining the rotor blades of a gas turbine engine to a rotor disc.

It is common practice for the blades, particularly the rotor blades, of a gas turbine engine to be retained by engagement of their roots in variously shaped axially extending slots in the periphery of the disc or other structure to which the blades are mounted. Clearly in these constructions it is necessary to provide means to prevent the blades moving axially in their slots, and there have been a large number of proposals for locking means of this nature.

One of the most widely used proposals has involved the use of a plurality of segmental lock plates which engage between facing grooves in the disc rim and the blade root structure respectively. These have not always been satisfactory, since where it is necessary to provide a sealed plenum adjacent the blade roots it is difficult to seal the multiple abutments between the separate plates, and it is normally necessary to provide complicated arrangements for assembling the plates into their respective grooves.

The present invention is intended to provide means for retaining blades to a disc or like structure which may be easily sealed to the blades and which may be simply retained to the disc.

According to the present invention means for retaining blades to a disc or like structure comprises a ring held to the disc or like structure by a connection of the bayonet type said ring engaging with said blades to restrain their axial movement in one direction with respect to the disc, and engagement means by which the blades engage with the ring to prevent its rotation with respect to, and consequent disconnection from, the disc.

In this specification the term "connection of the bayonet type" is to be understood to mean a connection in which projections from a first member each have an undercut surface facing the first member, adapted to engage with a face of the second member, the part of the second member having the face being cut away to enable the members to be assembled together by pushing them together so that the projections enter the cut away portions and align the undercut surface with the face, and relatively rotating the members to engage the undercut surface with the face.

Preferably the connection comprises projections from the disc which can pass beneath cut out portions of a inwardly facing surface of the ring and can then be rotated with the disc into a position in which they engage behind the non cut-away parts of said inwardly facing surface.

Preferably the engagement between the blades and the ring comprises a dog from each blade which engages with a cut out on the ring.

Conventional locking means may be provided at the end of the blade roots which do not engage with the ring.

Figure 2:
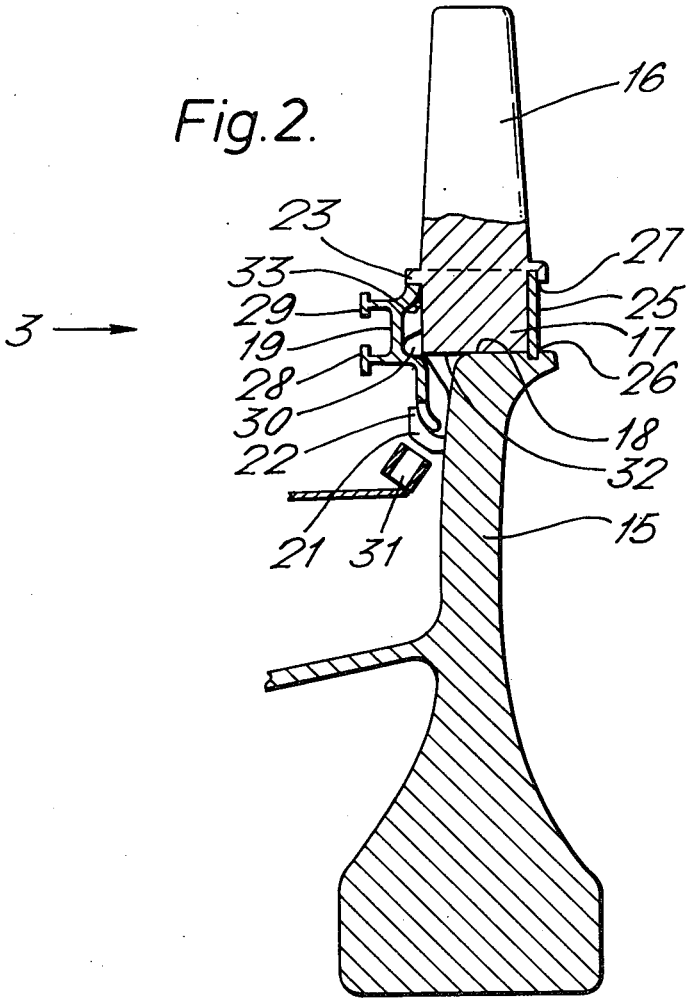
Figure 3:
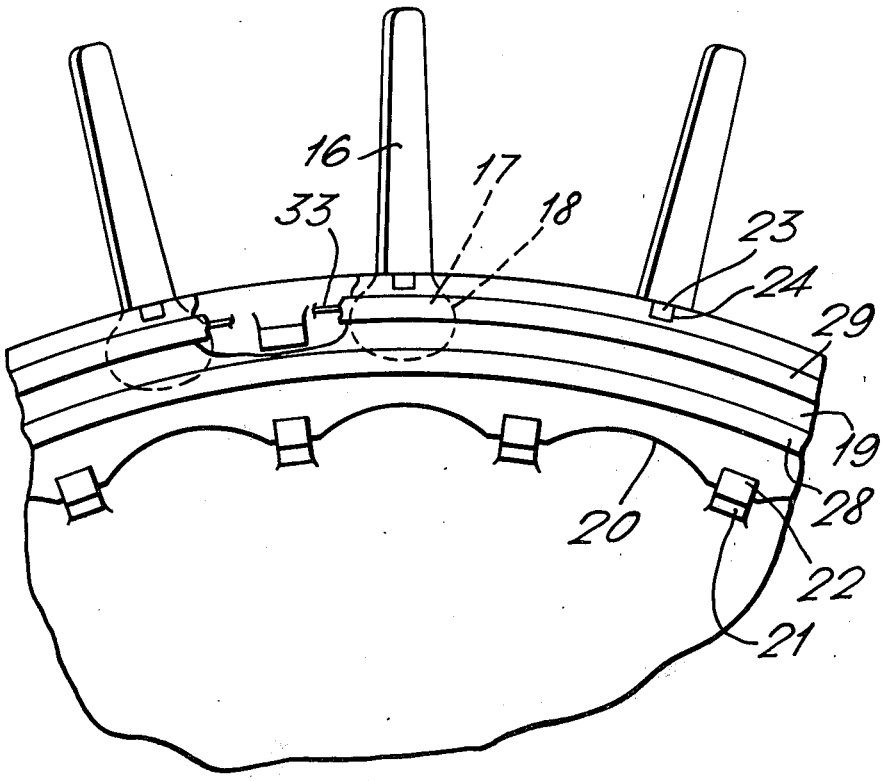

The invention will now be particularly described, merely by way of example, with reference to the accompanying drawings in which:

FIG. 1 is a partly cut-away view of a gas turbine having blade retaining means in accordance with the invention, FIG. 2 is an enlarged section of a turbine disc of the engine of FIG. 1, and FIG. 3 is a view on the arrow 3 of FIG. 2.

In FIG. 1 there is shown a gas turbine engine 10 comprising a compressor section 11, combustion section 12, turbine section 13 and final nozzle 14. The casing of the engine is broken away around the turbine section to expose to view the turbine rotor 15 to which are attached the turbine blades 16.

As will be best seen from FIGS. 2 and 3 the blades 16 are attached to the disc 15 by virtue of the dovetail roots 17, provided on each blade 16, hich engage with correspondingly shaped axially extending dovetail slots 18 formed in the periphery of the disc 15. It will be understood that it is necessary to retain the blades 16 against axial movement with respect to the disc, and to this end a ring 19 is provided. The ring 19 is of substantially the same diameter as the periphery of the disc 15. It is provided at its inner periphery with a series of cut-away portions 20 which are shaped so as to enable the ring to be pushed against the disc with the cut-away portions 20 passing over projections 21 from the disc. As can be seen from FIG. 2, when the ring 19 has been pushed against the disc, the portions of its inner periphery which are not cut-away lie rearwardly of the outwardly extending part 22 of the projections 21. Therefore the ring 19 may be rotated with respect to the disc 15 so that these non cut-away portions engage behind the parts 22, thus preventing the ring 19 moving away from the disc.

In this portion it will be seen from FIG. 2 that the outer periphery of the ring abuts against one face of the roots of the blades 16 and thus prevents them from axial movement in the left-hand direction as viewed in FIG. 2. It will also be seen that each blade 16 is provided with a projection 23 which engages with a corresponding cut-out portion 24 on the outermost periphery of the ring 19. Engagement between the projections 23 and the cut-away portions 24 prevents relative rotation between the ring 19 and the disc 15 and therefore prevents the ring from becoming disengaged from the parts 22.

It is also necessary to provide additional means to prevent the blades 16 from moving in the right-hand direction as shown in FIG. 2 with respect to the disc. Lock plates 25 are therefore provided which engage between grooves 26 and 27 formed in the disc and blade root respectively. These lock plates are of conventional form and are not therefore described in detail.

In the particular instance described above the ring 19 is used to support a pair of sealing ribs 28 and 29, and in order to provide additional support to the ring 19 a series of projections 30 from the disc 15 abut against the inner face of the ring so that loads may be taken between these projections and the parts 22.

In order to assemble the blades, ring and disc together it is necessary to carry out assembly in the following sequence; first the ring is attached to the disc by its bayonet connection, then the blades are slid into their dovetail slots from right to left as shown in FIG. 2, so that the projections 23 engage with the cut-away portions 24 to lock the ring in position. The blades are then locked in place by assembling the lock plates 25 between the slots 26 and 27, completing the assembly.

The present construction provides a particularly simple and effective way in which cooling air may be ducted to the blades 16. Thus by blowing cooling air through the nozzles 31 (FIG. 2) the cooling air may be caused to flow underneath the cut-away portions 20 and into the space between the ring 19 and the periphery of the disc 15. This space communicates at 32 with the undersurface of the blades 16 and it is a simple matter to provide apertures in this undersurface to allow the cooling air to flow inside the blades. It may be necessary to provide additional sealing means between the outer periphery of the ring 19 and the outer periphery of the disc 15 and the corresponding faces of the roots of the blades and in FIG. 2 there is shown a sealing wire 33 which is made of a malleable material and is trapped in the tapered gap between the ring and the disc. Centrifugal forces will cause the ring to expand and to provide an efficient seal between the ring and the disc.

It will be noted that a number of modifications could be made to the system illustrated. Thus it would be possible to arrange that the bayonet connection be formed on a separate portion of the ring intermediate the inner and outer peripheries, rather than making it on the inner periphery of the ring as at present. It will similarly be possible to move the engagement between the projections 23 and cut-away portions 24 to a different area of ring. Again it is not necessary for the ring to be used on the left-hand face of the disc as shown in FIG. 2, it would be possible to have the ring on the right-hand face of the disc, although it would not then be as convenient to use the ring to provide a plenum for cooling air.

I claim:

1. A rotor assembly comprising: a plurality of blades, a rotor disc having means for supporting said plurality of blades thereon against radial movement therefrom, a ring carried on said disc and engaging said blades to restrain their axial movement in one direction, a bayonet type of connection between said ring and said disc for holding said ring to said disc, and means providing engagement of at least some of said blades with said ring upon assembly of said blades on said disc to prevent said ring from rotating with respect to said disc and consequent disconnection of said ring from said disc.

2. A rotor assembly as claimed in claim 1 and in which said bayonet type connection comprises projections from said rotor disc, and an inward periphery of said ring, portions of said periphery being cut away so that said projections can pass beneath said cut-away portions and can then be rotated with the disc into a position in which they engage behind the remaining portions of said periphery.

3. A rotor assembly as claimed in claim 1 in which said engagement means includes at least some of said blades being provided with dogs extending therefrom, and said ring being provided with a corresponding number of recesses for receiving said dogs to form engagement between said ring and said blades and prevent consequent disconnection of said ring from said disc.

4. A rotor assembly as claimed in claim 1 and in which at least part of the inner periphery of said ring is spaced from said rotor disc to form an entry for cooling air to flow between the ring and disc and thence into the blades.

5. A rotor assembly as claimed in claim 1 and comprising nozzle means adapted to blow cooling air into said entry.

6. A rotor assembly as claimed in claim 1 and comprising a sealing wire trapped between said ring and said disc adjacent the outer periphery of the ring.

7. A rotor assembly as claimed in claim 1 and comprising locking means adapted to prevent axial movement between the blades and the rotor disc in the other direction.

* * * * *